United States Patent [19]

Fonner

[11] 4,157,732

[45] Jun. 12, 1979

[54] METHOD AND APPARATUS FOR WELL COMPLETION

[75] Inventor: Frederick A. Fonner, New Martinsville, W. Va.

[73] Assignee: PPG Industries, Inc., Pittsburgh, Pa.

[21] Appl. No.: 844,945

[22] Filed: Oct. 25, 1977

[51] Int. Cl.[2] ..... E21B 43/00

[52] U.S. Cl. ..... 166/315; 166/65 R

[58] Field of Search ..... 166/244 C, 65 R, 248, 166/315, 297; 175/57, 64

[56] References Cited

U.S. PATENT DOCUMENTS

| | | | |
|---|---|---|---|
| 1,608,709 | 11/1926 | Mills | 166/65 R X |
| 1,804,078 | 5/1931 | Baden | 166/65 R X |
| 2,149,617 | 3/1939 | Menaul | 166/65 R X |
| 2,418,343 | 4/1947 | Garol | 166/278 |
| 2,876,843 | 3/1959 | Huber | 166/55 |
| 2,926,603 | 3/1960 | Lindsay, Jr. | 102/20 |
| 3,057,405 | 10/1962 | Mallinger | 166/285 X |
| 3,076,507 | 2/1963 | Sweetman | 166/297 |
| 3,199,585 | 8/1965 | Cronberger | 166/65 R X |
| 3,273,641 | 9/1966 | Bourne | 166/276 |
| 3,312,280 | 4/1967 | Koplin | 166/285 |
| 3,333,635 | 8/1967 | Crawford | 166/276 |
| 3,360,047 | 12/1967 | Burnett | 166/229 X |
| 3,390,724 | 7/1968 | Caldwell | 166/100 |
| 3,434,537 | 3/1969 | Zandmer | 166/100 |
| 3,734,181 | 5/1973 | Shaffer | 166/65 R X |

OTHER PUBLICATIONS

Mills, "Protection of Oil and Gas Field Equipment against Corrosion", Dept. of Interior, Bureau of Mines Bulletin 233, 1925, pp. 17–25.

*Primary Examiner*—Stephen J. Novosad
*Attorney, Agent, or Firm*—Walter M. Benjamin

[57] ABSTRACT

Well completion apparatus is prepared in such a manner that a first metal element and a second metal element of the apparatus will have the capability of acting as a galvanic couple when contacted intimately with an electrolyte. During a sufficient amount of time of contact with the electrolyte, the first metal element will sacrificially corrode providing a passageway for flow of fluids between the interior and exterior of a conduit disposed in a well bore.

24 Claims, 3 Drawing Figures

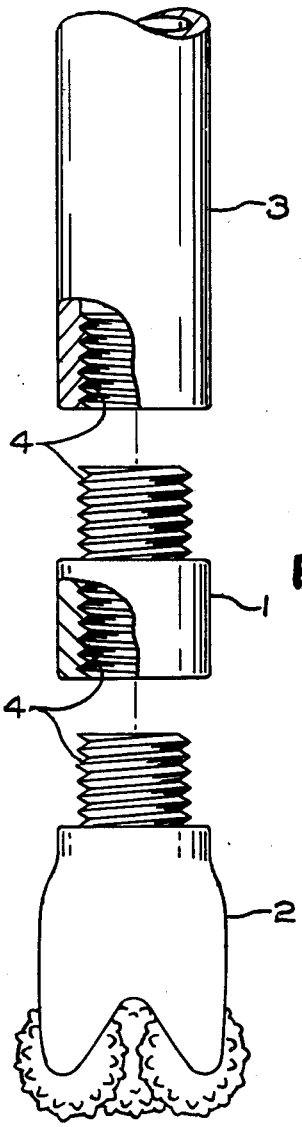
FIG. 1
FIG. 2
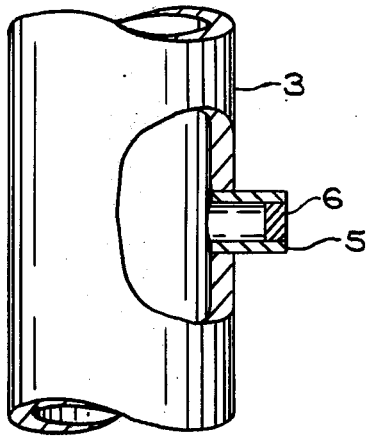
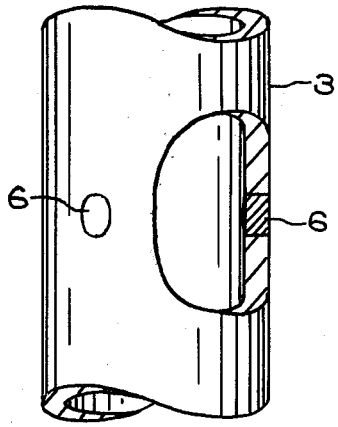
FIG. 3

METHOD AND APPARATUS FOR WELL COMPLETION

BACKGROUND OF THE INVENTION

1. Field of the Invention

This invention relates to a well completion apparatus and to methods for its use. More particularly, this invention relates to providing communication between the interior and exterior of a conduit disposed in a well bore penetrating production strata of a subterranean formation.

2. Description of the Prior Art

In most well bores, there are zones of strata in the formation through which the bore hole passes which should not be in communication with the well bore. These strata are excluded from communication with the well bore with a casing, liner, or tubing. By "casing" is meant a conduit of slightly smaller external diameter than the internal diameter of the bore hole and extends from the earth's surface to or beyond the producing strata. By "liner" is meant a conduit of smaller external diameter than the internal diameter of the casing to be disposed inside the casing but do not extend up to the earth surface. By "tubing" is meant a conduit usually of smaller external diameter than the internal diameter of the casing, in some cases smaller than the internal diameter of the liner to be disposed inside the well bore, casing or liner, extending from the earth's surface to any point below the earth's surface. Hereinafter, conduits refer to casings, liners or tubing. These conduits are disposed in the well bore and sometimes cemented in the well bore, i.e., the cement fills portions of the annular space between the well bore and the conduit to seal off the well bore above and/or below the production strata. Well bores which are intended for solution mining of metal salts, e.g., NaCl, KCl, etc., need not be cemented to seal the producing strata from that which overlies or underlies the strata because the liquid solvents used can be insulated from the roof and the floor of the cavity by light and heavy immiscible liquids and solids. After disposing the conduits in the well bore and whether cementing is done or not, communication between the conduits and the producing zone must be established.

The prior art has offered various methods for establishing communication between the conduit and the producing zone. Communication is made by such methods as removing a drill bit from the end of a drill pipe after drilling a well bore, thereby opening the end of the drill pipe. Subsequently, the drill pipe remains in the well bore to serve as a conduit because the cost of withdrawing a string of drill pipe can be just as expensive as the high cost of drilling. But, the removal of the drill bit is done commonly by explosives. This method is unsatisfactory due to the failure of ignited material to explode or due to damage of the subterranean formation because of shock waves that crack the cement or loosen rock strata. Loosened cement and rock clog the conduits or damage pumping machinery when debris is produced with the production fluid. The danger of explosives causing shock waves to collapse the roof of a solution mined cavity is even greater than in oil bearing sands and rock because of the greater amount of supporting material removed during most solution mining processes. Therefore, the use of explosives in solution mines is even more unsatisfactory because of the greater risk posed.

Another method of establishing communication between a conduit and a producing zone is by creating a passageway through protruding ports on the wall of a conduit or through the wall of the conduit itself. Passageways are made by perforating the conduit by the use of explosives, directing projectiles against a casing wall as taught by U.S. Pat. No. 2,876,843. This method is unsatisfactory for the reasons given above as well as due to the failure of the projectile to penetrate the conduit and/or the cement.

Many methods create passageways without the use of explosives such as by utilizing acid to attack a plug disposed in a port in the wall of a casing as taught by U.S. Pat. No. 3,312,280. This method also has its shortcomings, since extreme care must be taken so the acid does not attack the cement between the casing and the well bore, thereby weakening the sealing bond. Moreover, acid solutions may contaminate salt solutions desired to be produced. Also, once a small hole is created in an attacked section of the casing, the remaining acid may leak away before creating a large enough hole for production fluid to flow adequately through the casing wall.

U.S. Pat. No. 3,076,507 teaches the use of incendiary chemical fluids contained by an apparatus which directs the incendiary fluid against a certain area of a conduit, thereby creating a passageway through the conduit wall. This method can be extremely dangerous since some of the fluids utilized are volatile and difficult to keep under control. Inadvertent release of the fluid can be catastrophic. The extra expense of using treating fluids, as well as pre-ignitors in conjunction with the incendiary chemical fluids may also be required. The undesirability of using this method is self evident.

U.S. Pat. No. 3,360,047 teaches the use of displaceable plugs which are displaced by fluid pressure from the wall of a casing. When fluid pressure is applied to the casing, the plugs will be displaced leaving a passageway. This method is undesirable because it requires a source of fluid pressure at the well site, and there is an additional burden of having to make sure that all the joints in the casing and all connections are sufficiently tight so that enough fluid pressure can be developed to blow out or displace the plugs.

U.S. Pat. No. 3,057,405 teaches the use of ports which extend out of a section of the conduit, through which a passage is provided. A material which melts at a temperature close to the bottom hole temperature is disposed at the outer end of the passages. The bottom hole temperature is lowered previously by circulation of a cooling fluid through a string of tubing or drill pipe. The conduit string is then run into the well. The slowly warming up of the formation supplies the heat to melt the plugs thereby opening the passages. This method is very cumbersome in having to introduce a circulation conduit into the well. There is an additional problem of the plugs being removed prematurely if the conduit is thrust inadvertently against a hard object such as a rock protruding in the well bore. Also, unexpected high formation temperatures can cause premature melting of the plugs.

In conjunction with the shortcomings described, the prior art often require expensive equipment in order to affect communication between the conduit and the producing strata. Thus, these methods are also economically unattractive.

SUMMARY OF THE INVENTION

The shortcomings and dangers of the above-described art are overcome by the present invention. Communication between the interior of a conduit and the producing formation is made simple and economically attractive by well completion apparatus which comprises (1) a first metal element, such as a drill bit coupling, a plug in a protruding port on the wall of a conduit or a plug in the wall of a conduit, and (2) a second metal element such as a metal drill tube or a metal conduit. The first and second metal elements have the capability of acting as a galvanic couple when contacted intimately with a salt and/or alkaline electrolyte. Contact with the salt and/or alkaline electrolyte for a sufficient time causes a direct current of electricity to be produced by galvanic action, thereby causing the first metal element to be corroded sacrifically as a result of the galvanic action thereby leaving a hole in the conduit. Additionally, the sacrificing metal protects other more noble metals of the well completion apparatus from corrosion.

BRIEF DESCRIPTION OF THE DRAWINGS

To facilitate a clear understanding of the invention wherefrom further objects and advantages will become apparent, the detailed description thereof is made with reference to the drawings in which:

FIG. 1 is an exploded view of a drill bit and drill pipe to be connected by a coupling in accordance with the present invention;

FIG. 2 illustrates a port and a plug disposed in the wall of a conduit; and FIG. 3 illustrates a plug disposed in the wall of a conduit.

DETAILED DESCRIPTION OF THE INVENTION

When a pair of dissimilar metals are brought in contact with an electrolyte, the more noble metal will cause an electrochemical attack of the less noble metal. This is described as the galvanic effect. As a result of this effect, a direct current of electricity is produced by chemical action due to the migration of ions from the metal acting as the anode to the electrolyte and migration of ions from the electrolyte to the metal acting as the cathode. In the process, the anode is corroded, due to atoms or molecules of the anode going into the electrolyte solution. It has been found that this galvanic effect can be utilized in well completion apparatus. This well completion apparatus is comprised of two dissimilar metal elements so that when the two metals are in intimate contact with a salt and/or alkaline electrolyte, the less noble metal will be corroded leaving a passageway for flow of fluids into or out of a conduit disposed in a well bore.

In accordance with one embodiment of this invention (see FIG. 3), a plurality of plugs 6 are disposed in passages on the wall of a conduit 3 so that when the conduit is disposed in a well bore, removal of all or part of the plugs will cause communication (provide passage for flow of fluids) between the interior of the conduit and the producing zone of a subterranean formation. The subterranean formation may be that which produces oil, gas, aqueous solutions or any other fluid that can be run into or out of the conduit. There can be any number of plugs on the wall of the conduit, the influencing factors being that (1) the sum total of the cross-sectional area of the passages through the wall of the conduit is at least but preferably more than the cross-sectional area of the inside diameter of the conduit, (2) the size of the passages is not so small that it would cause excessive back pressure due to the viscosity of fluids flowing through them, (3) the passages do not weaken the structural integrity of the conduit having been designed for a particular use, i.e., as a casing, liner, or tube and (4) at least the same amount but preferably more contact area of the conduit is exposed than the contact area of the plugs.

The plugs can be secured in the passageways by threads on the outside of the plugs and on the inside of the passageway so that the plug can be screwed into the passageway. However, other means may be easily ascertained by those skilled in the art so long as the means provide electrical contact between the conduit and the plugs.

The plugs are made of a metal that is dissimilar to that of the conduit. By "dissimilar" is meant that the metal of the plug is less noble than the metal of the conduit or vice-versa. For example, zinc is less noble than steel. When the two metals are brought together, the zinc, being anodic and less noble than the steel, corrodes in some electrolytic environments while the steel, being cathodic and more noble, will not corrode. The table below shows metals and alloys in an order of increasing nobility.

*TABLE

| Galvanic Series of Metals and Alloys<br>Corroded End (Anodic, or Least Noble) |
|---|
| Magnesium |
| Magnesium alloys |
| Zinc |
| Aluminum 2S |
| Cadmium |
| Aluminum 17ST |
| Steel or iron |
| Cast iron |
| Chromium-iron (active) — stainless type 410 |
| Ni-Resist cast iron |
| 18-8 chromium-nickel-iron (active) stainless type 304 |
| 18-8-3 chromium-nickel-molybdenum-iron (active) — stainless type 316 |
| Lead-tin solders |
| Lead |
| Tin |
| Nickel (active) |
| Inconel nickel-chromium alloy (active) |
| Hastelloy alloy C (active) |
| Brasses |
| Copper |
| Bronzes |
| Copper-nickel alloys |
| Monel nickel-copper alloy |
| Silver solder |
| Nickel (passive) |
| Inconel nickel-chromium alloy (passive) |
| Chromium-iron (passive) — stainless type 410 |
| Titanium |
| 18-8 chromium-nickel-iron (passive) — stainless type 304 |
| 18-8-3 chromium-nickel-molybdenum-iron (passive) — stainless type 316 |
| Hastelloy alloy C (passive) |
| Silver |
| Graphite |
| Gold |
| Platinum |

*Protected End (Cathodic, or Most Noble)
Taken from Perry's Chemical Engineers Handbook, 4th Ed. (1963), page 23-4, McGraw Hill Publishing, New York, NY After consideration of other aspects of the property of materials for construction, one may choose the dissimilar metals to make the conduit and plugs. Commonly, conduits manufactured for use in well bores are made of steel, so preferably, the plugs are made from metals less noble than steel, i.e., magnesium, zinc, aluminum, or cadmium. Other combinations are within contemplation, however, such as copper-lead or tin-aluminum couples, but they are not economically attractive.

The plugs may be made of metals more noble than that of the conduit when an external potential source is used to override the corrosion potential between the metals. The polarity of the galvanic couple is thereby reversed so that plugs made from a metal that would be a cathode because of the corrosion potential would be an anode due to the overriding external potential. For example, plugs made from copper or lead would be a cathode when paired with a steel conduit due to the corrosion potential between their galvanic couples. When an external potential greater than the corrosion potential is applied across the copper-steel or lead-steel couples (positive on cathode and negative on anode), the polarity is reversed and the copper and lead plugs become the anodes. This is called impressing an e.m.f. across the metals. By impressing an e.m.f. across a copper-steel or lead-steel couple, the copper and lead plugs instead of the steel conduit would be corroded. If an e.m.f. is impressed across the galvanic couple, the metal electrodes must be insulated from each other and leads must be provided between the metal electrodes and the external potential source. External potential sources can be readily ascertained by those skilled in the art. A dry cell DC battery, for example, would suffice.

An external potential source may be used to increase or decrease the rate at which the anodic plugs will corrode. When the potential of an electrode is raised by the external potential source, the electrode is anodically polarized; when the potential is lowered by the external potential source, the electrode is cathodically polarized. The amount of polarization is the difference between the actual and equilibrium values of the electrode potential. Therefore, a designer using this embodiment of the present invention has great latitude in choice of metals for the plugs and conduit. But, it is preferred that the conduit be made of steel due to the availability of steel conduits and it is preferred that the plugs be made of magnesium, zinc, aluminum, or cadmium for a simple design not requiring the expense or added encumbrance of an external potential source.

The metals of the conduit and plugs are chosen so that the corrosion potential of their galvanic couple will cause corrosion of the anodic metal plug when the metals are contacted intimately with a salt/and or base electrolyte. By "intimate contact" is meant that both electrodes are in contact with the electrolyte providing consistent electrical continuity between the electrodes. The salt electrolytes are neutral solutions, i.e., nonoxidizing salt solutions such as chlorides, sulfates, etc. The base or alkaline electrolyte are caustic and mild alkalies and amines. However, amines are generally undesirable because of explosive nitrogen compounds that may be produced. Acids are also undesirable because of contaminating compounds produced that may be disposed to the environment. It is preferred that the electrolyte be sodium chloride brines, due to the frequent occurrence of sodium chloride brines in subterranean formations, or due to subterranean leaching operations which would result in sodium chloride brine. Another preferred electrolyte is potassium chloride brine.

It is preferred that the salt and/or alkaline concentration in the electrolyte be from 0.5 to 30 percent by weight or higher, e.g., saturation and more preferably about 15 percent salt and/or alkaline concentration by weight. The salt and/or alkali, accordingly, must have a solubility in water of at least 0.5 percent by weight and preferably at least 15 percent by weight. If the solubility of the salt and/or alkali is below this amount, the salt and/or alkali will not supply enough corroding media, e.g., salt ions in the electrolyte solution, to the reaction zone of the electrodes. Thus the corrosion rate will be greatly reduced if not completely stopped due to the deficiency of corroding media near the electrodes.

The electrolyte solution should be low in oxygen content. The lower the oxygen content, the faster the corrosion will take place. The oxygen content of the electrolyte solution should not be higher than that amount which exposure of the electrolyte solution to the atmosphere would dissolve; preferably, the oxygen content should be less. Oxygen causes oxide formation on the surface of the electrode thereby protecting the electrode from further galvanic action. Other inhibitors such as chromates, phosphates, and silicates are to be kept below a low concentration in the electrolyte solution. Preferably these inhibitors are kept below a concentration of a controlling influence on cathode- or anode-area reactions and more preferably, they are kept below a concentration of significant influence on cathode- or anode-area reactions The pH of the electrolyte solution should be 7 or higher. Generally, the higher the pH, the faster the rate of corrosion. The pH is a factor of corrosion rate because the solubility of corrosion films or products is usually a function of pH. Since the electrolyte solution of the present invention is neutral or alkaline, it is preferred that the pH of the electrolyte be 7 or above, and more preferably, between 7 and 10.

The temperature at which the present invention is practiced is the temperature of the strata into which the conduit is disposed. Generally, the higher the temperature, the faster the rate of corrosion will take place. The exception is when an increase in temperature will cause a change in some other overriding factor, such as a phase change in the electrolyte solution when the electrolyte as one phase, e.g., when gas, is less efficient than the electrolyte as another phase, e.g., liquid, or when an increase in temperature causes an increase in resistivity of the electrolyte solution. But for the practice of this invention, these exceptions are generally not present. Subterranean temperatures are high enough for a low electrolyte resistivity since resistivity generally decreases with an increase in temperature. Also, the increased pressures associated with the high subterranean temperatures is usually sufficient for the electrolyte to remain a liquid.

The rate at which corrosion takes place for a given temperature can best be determined by experimental data from tests conducted at that temperature, although theoretical rates can be calculated. The theoretical rate can be calculated from the relation, $$\Delta V = nF\,(\delta\epsilon/\delta p)\,T$$

where $\Delta V$ is the increment in volume for the reaction actually occurring in the cell;

n is the number of equivalents per mole of reaction in the cell;

F is the Faraday constant;

$\epsilon$ is the electromotive force of the cell;

p is the pressure; and

T is the constant temperature for $\epsilon$.

An additional corrosion rate influencing factor that can be used by a designer using the instant invention is agitating the electrolyte solution. This increases the corrosion rate because it removes scales and protective films from the electrodes and also supplies continual corroding media, e.g., supplying salt ions dissolved in the electrolyte to the electrodes. However, agitation is not necessary unless diffusion of the sacrificed metal ions and diffusion of the corroding media, due to concentration gradients within the electrolyte solution does not (1) sufficiently reduce the enrichment of sacrificed metal ions near the anode or (2) sufficiently increase the deficiency of electrolyte ions near the cathode. Both conditions are necessary for a fast rate of corrosion to be maintained. Thus, the extra expense of agitation should not be employed unless it is necessary. Agitating the solution includes replenishing the electrolyte solution near the electrodes when an open system is used, i.e., feeding the electrolyte solution to the electrodes from a source external to the reservoir of electrolyte solution in which the electrodes are inserted.

The metals of the conduit and the plugs are chosen so that upon contact of the metals with the electrolytic solution, corrosion of the plugs will take place in the desired time which is commensurate with well completion. That is after disposition of a conduit within a well bore and well completion activities are completed, it is desired that the corrosion of plugs be completed soon thereafter. Therefore, the corrosion potential between the plugs and the conduit should be such that only enough time is allowed to finish other well completion activities before the plugs are corroded, e.g., about 20 days or less. By utilizing the rate influencing factors set forth above, a designer using the present invention can design a system whereby the time frame criteria will be met.

In a further embodiment of this invention (see FIG. 1), a metal drill 3 connected to a drill bit 2 by a metal coupling, is used for well completion. In this embodiment, the metal coupling and metal drill pipe are dissimilar so that upon contact of the metal coupling and metal drill pipe with a salt and/or alkaline electrolyte, the coupling will corrode thereby disconnecting the drill bit from the drill pipe thereby leaving an opening at the end of the drill pipe for flow of fluids through the drill pipe. Thus, after the drill pipe is used for drilling, it can be used for a conduit without the further expense of withdrawing the drill pipe from the well bore.

The coupling of the present invention will have means for connecting the coupling to the drill bit and it will have means for connection to the drill pipe. The connecting means can be the same as that which is used in the existing art to connect a drill bit to a drill pipe. e.g., threads 4. Thus, the coupling can be cylindrically shaped with threads 4 on each end. The coupling need be only big enough to have provisions for the connection means and to withstand the forces and stresses resulting from a drilling operation. Thus, an optimally designed coupling has the smallest volume of material that must be corroded, e.g., a volume that will corrode in about 20 days.

The metals for the coupling and drill pipe are chosen by the same criteria as that of the first-described embodiment. As in the first-described embodiment, it is preferred that the drill pipe be made of steel due to the availability of steel drill pipe. Due to the extra strength required of the coupling, however, it is preferred that the coupling be made of aluminum alloy number 7075 (QQ-A-282; A.S.T.M. B211) which has been heat treated and artificially aged to a high temper and has a yield strength of aroung 70,000 p.s.i. Weaker alloys, e.g., aluminum 2024 (QQ-A-268; A.S.T.M. B211) can be used depending on the drill pipe size. Generally, the weaker alloys have a greater corrosion potential, e.g., 25 percent greater. So, a weaker alloy may be chosen for the benefit of a shorter corrosion time, e.g., 10 percent shorter. High strength magnesium alloys, such as magnesium alloy number AZ80A, which has been age hardened is preferred for very high corrosion potentials and very short corrosion time, e.g., about one day, when paired with steel drill pipe.

Yet, a further embodiment of the present invention (see FIG. 2) is similar to the first-described embodiment except the plug 6 is disposed in a steel port 5 protruding from the side of the conduit 3 instead of being disposed in the wall of the steel conduit. The ports are typically cylindrical in shape and extend from the outside diameter of the conduit to the inside wall of the well bore. The plug is secured in a passageway made through the port and wall of the conduit. These ports provide protrusion through the annular space in which cement may be disposed.

To use the apparatus of the described embodiments, a well is drilled to or through a producing formation. If a cavity is not already existing in the producing formation, a cavity is then formed by well-known techniques. If the formation is salt bearing, it is preferred that the cavity be formed by leaching with an aqueous leaching solution. Thus, a salt brine is produced to serve as the electrolyte in which the galvanic action takes place. Under other circumstances, the electrolyte would be introduced into the cavity through the well bore. The cavity should be big enough to contain at least a volume of electrolyte that will hold the corroded metal in solution and preferably the cavity should be big enough to contain more than the volume of electrolyte that will hold the corroded metal in solution. Of course, when a replenishing supply of electrolyte is continually supplied from the earth's surface and withdrawn to the earth's surface, there is only a need for a very small cavity, if any at all. The cavity should be located at a depth so that after disposing the conduit into the well bore, the electrolyte in the cavity will contact at least the same amount, but preferably more of the surface area of the cathodic electrode than the anodic electrode. This is necessary because the anodic metal corrodes faster when a larger amount of the surface of the cathodic metal is contacted with the electrolyte.

The conduit is then diposed in the well bore at a time, with respect to other well completion activities, e.g., cementing, when it is desired to initiate the corrosion. In the case of the drill pipe being used as a conduit subsequent to drilling, corrosion of the anodic metal coupling is initiated by the introduction of the electrolyte into the cavity. The electrolyte may be introduced through the means by which the drill bit was lubricated, through special tubing run down into the well bore for that purpose or through the drill pipe itself. Final well completion activities are then performed while corrosion is taking place.

Now that the inventive concept has been described through several embodiments, a particular example will be set forth to further illustrate the invention. However, neither the three described embodiments nor this particular example should be considered as a limitation on the scope of the invention.

EXAMPLE I

A test cell was set up with equal size electrodes to determine the bimetallic potentials and currents in a 53 gram per liter sodium chloride solution when the sacrificial metals were connected. The temperature of the solution was 75° F. Pressure was atmospheric and constant throughout the test. The results were the following:

| Electrodes | Current (ma) | Emf (Volts) |
|---|---|---|
| Fe - Mg | 126.0 → 115.00 | 0.50 |
| Fe - Zn | 7.0 → 2.1 | 0.44 |
| Fe - Al 7072 | 1.2 → 0.6 | 0.21 |
| Fe - Al 1100 | 1.7 → 0.20 | 0.17 |

It would appear from the above data that any of the metals shown would slowly go into solution. The weight loss of aluminum was calculated to be 14.1 milligrams per square inch per hour.

EXAMPLE II

A test cell was set up with equal size electrodes to determine the bimetallic potentials and currents in a 15 percent sodium hydroxide solution at 75° F. Pressure was atmospheric and constant throughout the test. When the sacrificial metals were connected, the results were as follows:

| Electrodes | I (ma) | Emf (Volts) |
|---|---|---|
| Fe - Mg | 1.81 ← 2.15 | 0.55 ← 0.67 |
| Fe - Zn | [1]8.00 ← 29.00 | 0.44 ← 0.55 |
| Fe - Al 7072 | 42.00 ← 50.00 | 0.56 ← 0.63 |
| Fe - Al 1100 | 48.00 ← 73.00 | 0.38 ← 0.74 |

[1]After 17 hours, the I for the Fe-Zn couple dropped to 2 (ma).

It can be seen from the data that the zinc/ferrous couple and the magnesium/ferrous couple was not attacked by the sodium hydroxide solution. Thus, sodium chloride is a better electrolyte for the magnesium and zinc couples. However, the aluminum/ferrous couple increased in potential by a factor of approximately 50 from that of Example I. The weight loss of aluminum was calculated to be 82.1 milligrams per square inch per hour. Sodium hydroxide can therefore be introduced into a cavity to enhance the corrosion rate of aluminum/ferrous couples.

It should be understood that numerous alterations and modifications may be made to the details of the illustrations, such that other embodiments of the inventive concept may be produced, so any limitation which such illustration may place on the invention is not intended except to the extent described in the Claims.

What is claimed is:

1. An apparatus for well completion comprising a conduit disposed in a well bore to provide passageway for flow of fluids between the interior of the conduit and subterranean strata, the apparatus including a first metal element separating the interior of the conduit and the subterranean strata and a second metal element, the first and second metal elements having the capability of acting as a galvanic couple when contacted intimately with an electrolyte for a time commensurate with well completion which is sufficient to sacrificially corrode the first metal element, as a result of galvanic action, until the passageway is provided for flow of the fluids between the interior of the conduit and the subterranean strata.

2. The apparatus of claim 1, wherein the first metal element is a coupling mounting a drill bit at the end of a metal drill pipe, the metal coupling comprising connecting means for mounting the metal coupling to the drill bit and a connecting means for mounting the metal coupling to the metal drill pipe.

3. The apparatus of claim 1, wherein the first metal element is a plug disposed in a port mounted on the wall of a conduit.

4. The apparatus of claim 1, wherein the first metal element is a plug disposed in the wall of a conduit.

5. The apparatus of claim 1, wherein the electrolyte is selected from the group consisting of aqueous sodium chloride, potassium chloride and sodium hydroxide solutions.

6. The apparatus of claim 1, wherein the first metal element is made from a metal selected from the group consisting of magnesium, zinc, cadmium and aluminum and the second metal element is made of steel.

7. The apparatus of claim 1, wherein the electrolyte is selected from the group consisting of neutral salt solutions, alkaline solutions and mixtures of neutral salt and alkaline solutions.

8. The apparatus of claim 1, wherein th conduit is made of a metal more noble than the first metal element.

9. A method of well completion comprising the steps of:

(1) disposing into a well bore a conduit comprising a first metal element separating the interior of the conduit and a subterranean strata and a second metal element, the first and second metal elements having the capability of acting as a galvanic couple when contacted intimately with an electrolyte, and (2) contacting intimately the metal elements with the electrolyte for a time sufficient to sacrificially corrode the first metal element, as a result of galvanic action, until a passageway is provided for flow of fluids between the interior of the conduit and the subterranean strata.

10. The method of claim 9, wherein the first metal element is a coupling for mounting a drill bit at the end of a metal drill tube, the metal coupling comprising connecting means for mounting the metal coupling to the drill bit and a connecting means for mounting the metal coupling to the metal drill tube.

11. The method of claim 9, wherein the first metal element is a plug disposed in a port mounted on the wall of a conduit.

12. The method of claim 9, wherein the first metal element is a plug disposed in the wall of a conduit.

13. The method of claim 9, wherein the electrolyte is selected from the group consisting of aqueous sodium chloride, potassium chloride and sodium hydroxide solutions.

14. The method of claim 9, wherein the first metal element is made from a metal selected from the group consisting of magnesium, zinc, cadmium and aluminum and the second metal element is made of steel.

15. The method of claim 9, wherein the electrolyte is selected from the group consisting of neutral salt solutions, alkaline solutions and mixtures of neutral salt and alkaline solutions.

16. The method of claim 9, wherein the conduit is made of a metal more noble than the first metal element.

17. An apparatus for well completion comprising a conduit disposed in a well bore which extends from the earth's surface through a first zone of subterranean strata with which communication is not to be established and to a second zone of subterranean strata, the conduit comprising a first metal element, which only excludes communication with the second zone, and a second metal element, the first and second metal elements forming a galvanic couple when contacted intimately with an electrolyte thereby to corrode the first metal element.

18. The apparatus of claim 17, wherein the first metal element is a plug means.

19. The apparatus of claim 17, wherein the first metal element is a connecting means.

20. The apparatus of claim 17, wherein the electrolyte is selected from the group consisting of neutral salt solutions, alkaline solution and mixtures of neutral salts and alkaline solutions.

21. The apparatus of claim 17, wherein the conduit is made of a metal more noble than the first metal element.

22. A method of well completion comprising the steps of:

(1) disposing a conduit into a well bore which extends from the earth's surface through a first subterranean zone with which communication is not to be established and to a second subterranean zone, the conduit comprising a first metal element which only excludes communication with the second zone and a second metal element, the first and second metal element forming a galvanic couple when contacted with an electrolyte; and (2) contacting intimately the metal elements with the electrolyte for a time sufficient to sacrificially corrode the first metal element, as a result of galvanic action, until communication is established with the second zone.

23. The method of claim 22, wherein the electrolyts is selected from the group consisting of neutral salt solutions, alkaline solutions and mixtures of neutral salt and alkaline solutions.

24. The method of claim 22, wherein the conduit is made of a metal more noble than the first metal element.

* * * * *